US007542062B2

(12) United States Patent
Sugimoto

(10) Patent No.: US 7,542,062 B2
(45) Date of Patent: Jun. 2, 2009

(54) INTEGRATED CIRCUIT OF AN IMAGE FORMING APPARATUS HAVING DRIVE CIRCUITS

(75) Inventor: Tasuku Sugimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/476,801

(22) Filed: Jun. 29, 2006

(65) Prior Publication Data

US 2007/0003312 A1 Jan. 4, 2007

(30) Foreign Application Priority Data

Jun. 30, 2005 (JP) ..... 2005-191578
Jun. 23, 2006 (JP) ..... 2006-173440

(51) Int. Cl.
*B41J 2/435* (2006.01)
*B41J 2/47* (2006.01)

(52) U.S. Cl. ..... 347/237; 347/247

(58) Field of Classification Search ..... 347/230, 347/237, 241–245, 247, 256–261, 231; 358/1.5; 399/88, 92

See application file for complete search history.

(56) References Cited

U.S. PATENT DOCUMENTS

| | | | | |
|---|---|---|---|---|
| 5,510,827 | A * | 4/1996 | Kubota et al. | 347/257 |
| 5,677,723 | A * | 10/1997 | Soya et al. | 347/247 |
| 6,262,805 | B1 * | 7/2001 | Ishikawa et al. | 358/1.15 |
| 6,826,377 | B2 * | 11/2004 | Kitozaki | 399/88 |
| 6,907,206 | B2 | 6/2005 | Hattori et al. | |
| 7,248,276 | B2 * | 7/2007 | Suzuki | 347/237 |
| 7,372,591 | B2 * | 5/2008 | Sugimoto | 358/1.15 |
| 2003/0219274 | A1 * | 11/2003 | Hirose et al. | 399/92 |
| 2006/0033804 | A1 * | 2/2006 | Dan | 347/230 |

FOREIGN PATENT DOCUMENTS

| | | |
|---|---|---|
| JP | 10-133539 | 5/1998 |
| JP | 2000-134787 | 5/2000 |
| JP | 2004-157463 | 6/2004 |

* cited by examiner

*Primary Examiner*—Hai C Pham
(74) *Attorney, Agent, or Firm*—Banner & Witcoff, Ltd.

(57) ABSTRACT

An image forming apparatus includes: a main motor that drives a photosensitive element; a polygon motor that drives a polygon mirror; a main motor drive circuit that drives the main motor; a polygon motor drive circuit that drives the polygon motor; a package; and a board, wherein: the package is mounted on the board and is disposed in a vicinity of the main motor; and the main motor drive circuit and the polygon motor drive circuit are formed in the package.

16 Claims, 10 Drawing Sheets

INTEGRATED CIRCUIT OF AN IMAGE FORMING APPARATUS HAVING DRIVE CIRCUITS

CROSS-REFERENCE TO THE RELATED APPLICATION(S)

This application is based upon and claims a priority from prior Japanese Patent Applications No. 2005-191578 filed on Jun. 30, 2005, and No. 2006-173440 filed on Jun. 23, 2006, the entire contents of which are incorporated herein by reference.

TECHNICAL FIELD

Aspects of the present invention relate to an image forming apparatus such as a laser printer.

BACKGROUND

In relation to a conventional art image forming apparatus such as a laser printer, a motor drive unit, which has a control circuit for effecting digital control and a motor drive circuit for driving a motor upon receipt of a command from this control circuit, for controlling a brushless DC motor is provided. For instance, JP-A-2000-134787 discloses an image forming apparatus having a main motor driver and a polygon motor driver, which are provided on separate control boards. The main motor driver drives and controls a main motor. The main motor performs mechanical driving of an image forming unit, a transfer unit, a fixing unit, and the like. The polygon motor driver drives and controls a polygon motor used for rotating a polygon mirror of a scanner unit that exposes the surface of a photosensitive drum in order to form an electrostatic latent image.

SUMMARY

In JP-A-2000-134787, two control boards respectively carrying the main motor driver and the polygon motor driver occupy space. Consequently, there arises a problem that a main body of a laser printer with two control boards becomes bulky.

Aspects of the present invention provide an image forming apparatus that enables a reduction in the size of a layout space for a main motor driver and a polygon motor driver.

According to an aspect of the invention, there is provided an image forming apparatus including: a main motor that drives a photosensitive element; a polygon motor that drives a polygon mirror; a main motor drive circuit that drives the main motor; a polygon motor drive circuit that drives the polygon motor; a package; and a board, wherein: the package is mounted on the board and is disposed in a vicinity of the main motor; and the main motor drive circuit and the polygon motor drive circuit are formed in the package.

According to the above aspect, the main motor drive circuit and the polygon motor drive circuit are formed in a single package. Therefore, a layout space for the two drive circuits can be reduced. Consequently, a size of the image forming apparatus can be reduced. Moreover, the board having the package mounted thereon is provided in a vicinity of the main motor, and therefore radiation noise caused by a signal, which is exchanged between the package and the main motor, can be diminished.

According to another aspect of the invention, there is provided an image forming apparatus including: a main motor that drives a photosensitive element; a polygon motor that drives a polygon mirror; a main motor drive circuit that drives the main motor; a polygon motor drive circuit that drives the polygon motor; a package; and a board, wherein: the package is mounted on the board and is disposed in a vicinity of the polygon motor; and the main motor drive circuit and the polygon motor drive circuit are formed from the package.

According to the above aspect, the main motor drive circuit and the polygon motor drive circuit are formed in a single package. Therefore, a layout space for the two drive circuits can be reduced. Consequently, a size of the image forming apparatus can be reduced. Moreover, since the board having the package mounted thereon is provided in a vicinity of the polygon motor, a Hall element signal, which is exchanged between the package and the polygon motor and used for detecting the rotational speed of the polygon motor, becomes stable. Thus, the rotational accuracy of the polygon motor is enhanced.

BRIEF DESCRIPTION OF THE DRAWINGS

These and other objects and advantages of the present invention will be more fully apparent from the following detailed description taken in conjunction with the accompanying drawings, in which.

DETAILED DESCRIPTION OF THE ILLUSTRATIVE ASPECTS

First Aspect

Figure 1:
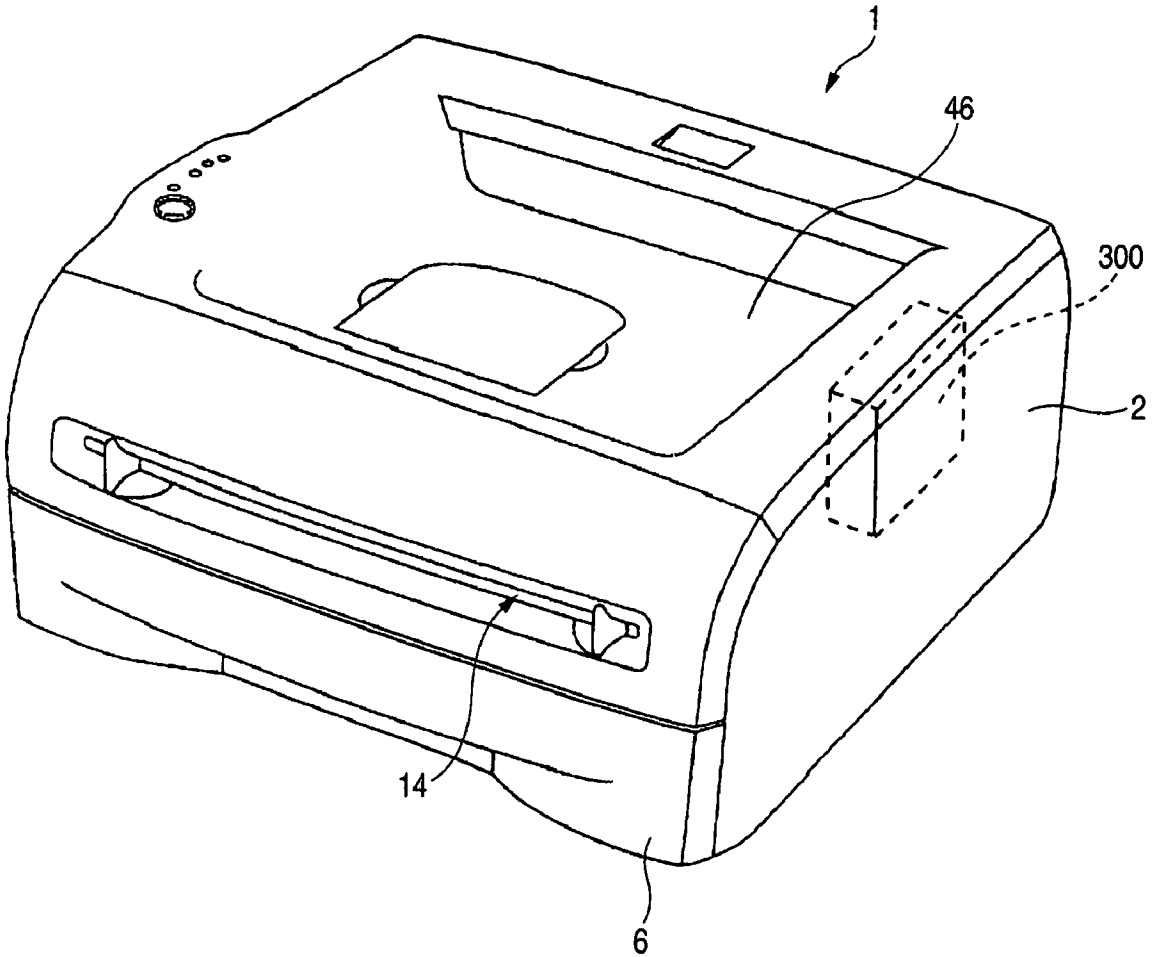
FIG. 1 is a perspective view showing a laser printer 1 as an image forming apparatus according to an aspect of the invention.
Figure 2:
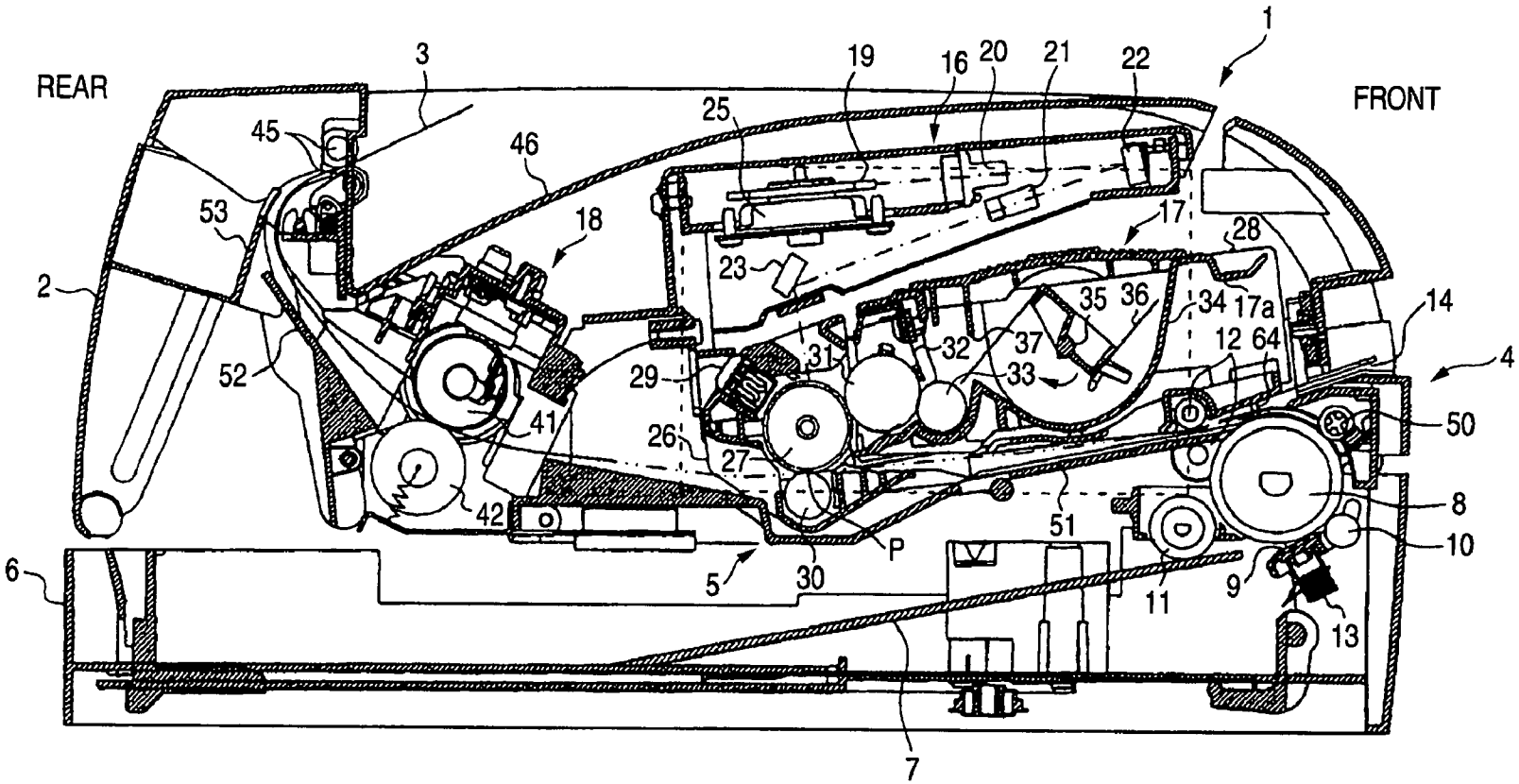
FIG. 2 is a side cross-sectional view of the laser printer.

The overall configuration of a laser printer, which acts as an image forming apparatus according to an aspect of the present invention will first be described with reference to FIGS. 1 and 2. FIG. 1 is a perspective view illustrating a laser printer 1. FIG. 2 is a side cross-sectional view of the laser printer 1. In FIG. 2, the laser printer 1 is viewed from axial directions of various rollers to be described later. In this drawing, the right side is called a front side, and the left side is called a rear side.

As shown in FIG. 1, the laser printer 1 is provided with a main body casing 2. As shown in FIG. 2, a feeder unit 4 used for feeding a sheet 3 and an image forming unit 5 used for forming a predetermined image on the fed sheet 3 are provided in the main body casing 2. As shown in FIG. 1, a heat radiation fin 300, which functions as a heat radiation unit, is provided at an inner right position of the main body casing 2 viewed from the front side of the laser printer 1. As shown in FIGS. 1 and 2, a sheet discharge tray 46 used for placing the sheet 3, on which an image has been formed by the laser printer 1 and which has been discharged, is provided on the top of the laser printer 1.

The feeder unit 4 includes a sheet feeding tray 6; a sheet press plate 7 provided in the sheet feeding tray 6; a delivery roller 11 provided at a position above one end of the sheet feeding tray 6; a sheet feeding roller 8 and a separation pad 9; a pinch roller 10 opposed to the sheet feeding roller 8; a paper dust removal roller 50; and a registration roller 12 disposed downstream of the paper dust removal roller 50 in a the transport direction of the sheet 3.

The sheet feeding tray 6 is detachably attached to the bottom of the main body casing 2 and is used for storing therein the sheets 3 in a stacked manner. When the inside of the sheet feeding tray 6 is to be replenished with the sheets 3, or for a like purpose, the sheet feeding tray 6 is withdrawn toward the front side of the laser printer 1 (i.e., the right side in FIG. 2).

One end of the sheet-press plate 7, which is distant from the sheet feeding roller 8, is pivotably supported, whereby the other end proximal to the sheet feeding roller 8 can be vertically moved and urged upwardly by a spring (not shown). Therefore, as the quantity of stacked sheets 3 increases, the sheet press plate 7 is downwardly pivoted against the restoration force of the spring while the end thereof distant from the sheet feeding roller 8 is taken as a fulcrum.

The delivery roller 11 is set so as to come into contact with the top of the sheets 3 stacked on the sheet press plate 7 in the sheet feeding tray 6. The sheet feeding roller 8 delivers the sheet 3 up to a deliverable position (i.e., a position between the sheet feeding roller 8 and the separation pad 9).

The separation pad 9 is opposed to the sheet feeding roller 8. By a spring 13 disposed on the back of the separation pad 9, the separation pad 9 is pressed toward the sheet feeding roller 8. The sheet 3 delivered by the delivery roller 11 comes into contact with the sheet feeding roller 8 and the separation pad 9. At this time, appropriate frictional force is exerted between the separation pad 9 and the sheet 3. Hence, even when plural sheets 3 have been sent to the separation pad by the delivery roller 11, the sheets 3 other than the topmost sheet 3 are caught by the separation pad 9. Thus, the sheet feeding roller 8 feeds the sheet 3 one at a time.

The registration roller 12 is formed from a pair of rollers and corrects a skew of the sheet 3. When the sheet 3 has become slacked upon contact with the registration roller 12, the registration roller 12 is driven, to thus send the sheet 3 to the image forming unit 5.

A manual sheet feeding port 14 used for feeding the sheet 3 directly to the position of the registration roller 12 from the front side of the laser printer 1 is formed at a position slightly upward from the sheet feeding roller 8. Thus, the sheet 3 can be supplied to a transport path without being stored in the sheet feeding tray 6.

The image forming unit 5 has a scanner unit 16, a process unit 17, and a fixing unit 18.

The scanner unit 16 is disposed at an upper position within the main body casing 2. The scanner unit 16 includes a laser emission unit (not shown), a polygon mirror 19 rotationally driven by a polygon motor 25; lenses 20 and 21; and reflection mirrors 22 and 23. As indicated by a dashed line in FIG. 2, a laser beam, which is emitted from the laser emission unit and is based on predetermined image data, is caused to sequentially pass through or undergo reflection from the polygon mirror 19, the lens 20, the reflection mirror 22, the lens 21, and the reflection mirror 23. Thus, the surface of a photosensitive drum 27, which functions as a photosensitive element in the process unit 17 to be described later, is scanned at high speed. A polygon motor 25 is a brushless DC motor in this aspect.

The process unit 17 is disposed below the scanner unit 16 and is detachably attached to the main body casing 2 in substantially the horizontal direction (front and rear direction). The process unit 17 includes a drum cartridge 26 and a development cartridge 28.

The drum cartridge 26 has the photosensitive drum 27, a scorotron charger 29, and a transfer roller 30. The development cartridge 28 has a development roller 31, a layer thickness regulatory blade 32, a toner supply roller 33, and a toner box 34. The development cartridge 28 is removably attached to the drum cartridge 26.

The toner box 34 is filled with toner. By rotation of an agitator 36 in the direction of an arrow (in a clockwise direction), which is supported by a rotary shaft 35 provided in the center of the toner box 34, the toner in the toner box 34 is agitated and is discharged from a toner supply port 37 formed in the toner box 34.

The toner discharged from the toner supply port 37 is supplied to the development roller 31 by rotation of the toner supply roller 33. At this time, the toner is positively charged between the toner supply roller 33 and the development roller 31 by friction, and the toner supplied over the development roller 31 further enters a space between the layer thickness regulatory blade 32 and the development roller 31 in association with rotation of the development roller 31. The toner is more sufficiently charged here by friction, and the toner is carried on the development roller 31 as a thin layer of given thickness.

The photosensitive drum 27 is rotatably disposed at a position beside, the development roller 31 in an opposed manner so as to be rotatable in the clockwise direction. In the photosensitive drum 27, a drum main body is grounded, and the surface of the drum main body is formed from a positively chargeable photosensitive layer made of polycarbonate or the like. The photosensitive drum 27 is configured so as to be rotationally driven by the power from a main motor 118 (see FIG. 3) to be described later.

The scorotron charger 29 is spaced from the photosensitive drum 27 at a predetermined interval so as to avoid contact with the photosensitive drum 27. The scorotron charger 29 is disposed at a position which is elevated about 30° from the horizontal direction with respect to the photosensitive drum 27. This scorotron charger 29 positively charges the photosensitive drum 27 and generates a corona discharge from an charging wire such as tungsten. The scorotron charger 29 uniformly charges the surface of the photosensitive drum 27 with positive polarity.

The transfer roller 30 is disposed opposite the photosensitive drum 27 at a position beneath the photosensitive drum 27. The transfer roller 30 is supported by the drum cartridge 26 so as to be rotatable in a counterclockwise direction. This transfer roller 30 is made by coating a metal roller shaft with a roller made of an ionic conductive rubber material. A transfer bias (forward transfer bias) is applied to the transfer roller 30 during transfer operation.

The fixing unit 18 is disposed downstream of the process unit 17 in the transport direction of the sheet. The fixing unit 18 has a fixing roller 41 and a press roller 42 used for pressing the fixing roller 41.

The fixing roller 41 has a metal halogen lamp (not shown) for heating purpose. The press roller 42 is configured so as to come into close contact with the fixing roller 41 or the sheet 3 and rotate in synchronism with the fixing roller 41.

Printing operation of the laser printer 1 will now be described with reference to FIG. 2.

First, the sheet 3 fed by the sheet feeding roller 8 is sent to the transport path for the sheet 3 (indicated by a chain double dashed line in FIG. 2). At this time, the sheet 3 is sent to the registration roller 12 after paper dust has been removed from the sheet by the paper dust removal roller 50. The registration roller 12 corrects the skew of the sheet 3 and delivers the sheet 3 to the image forming unit 5. In the meantime, the surface of the photosensitive drum 27 is uniformly, positively charged by the scorotron charger 29 in association with rotation of the photosensitive drum 27. Subsequently, the surface of the photosensitive drum 27 is exposed to the laser output from the scanner unit 16 by high speed scanning, whereupon an electrostatic latent image is formed on the basis of predetermined image data. When the positively-charged toner carried on the development roller 31 opposes and contacts the photosensitive drum 27 by rotation of the development roller 31, the toner is supplied to the electrostatic latent image formed on the surface of the photosensitive drum 27; i.e., exposed areas, whose electric potential has dropped as a result of exposure to the laser beam, on the surface of the uniformly, positively-charged photosensitive drum 27. The toner is selectively carried, to thus form a visible image, whereby reversal development is achieved. The visible image carried on the surface of the photosensitive drum 27 is transferred to the sheet 3 while the sheet 3 passes between the photosensitive drum 27 and the transfer roller 30 (i.e., the image forming position P). When the sheet 3 having the visible image transferred thereon is transported from the image forming unit 5, the fixing roller 41 heats and pressurizes the toner, which has been transferred on the sheet 3 by the process unit 17, while the sheet 3 passes between the fixing roller 41 and the press roller 42, to thus fix the toner. Further, the fixing roller 41 transports the sheet 3, on which the image has been fixed, up to a discharge roller 45 by way of a sheet discharge path formed by guide members 52, 53. The discharge roller 45 discharges the transported sheet 3 onto the sheet discharge tray 46.

Figure 3:
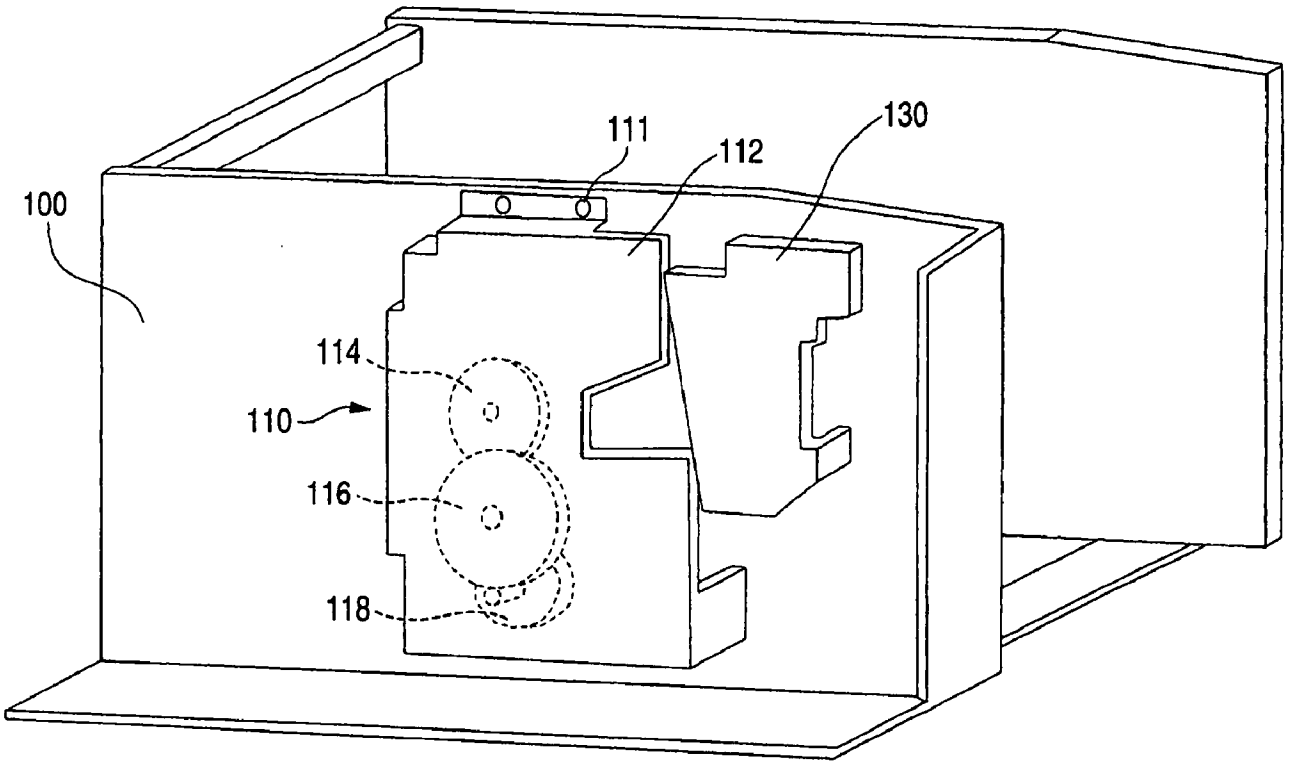
FIG. 3 is a perspective view showing the layout of a gear unit.
Figure 4:
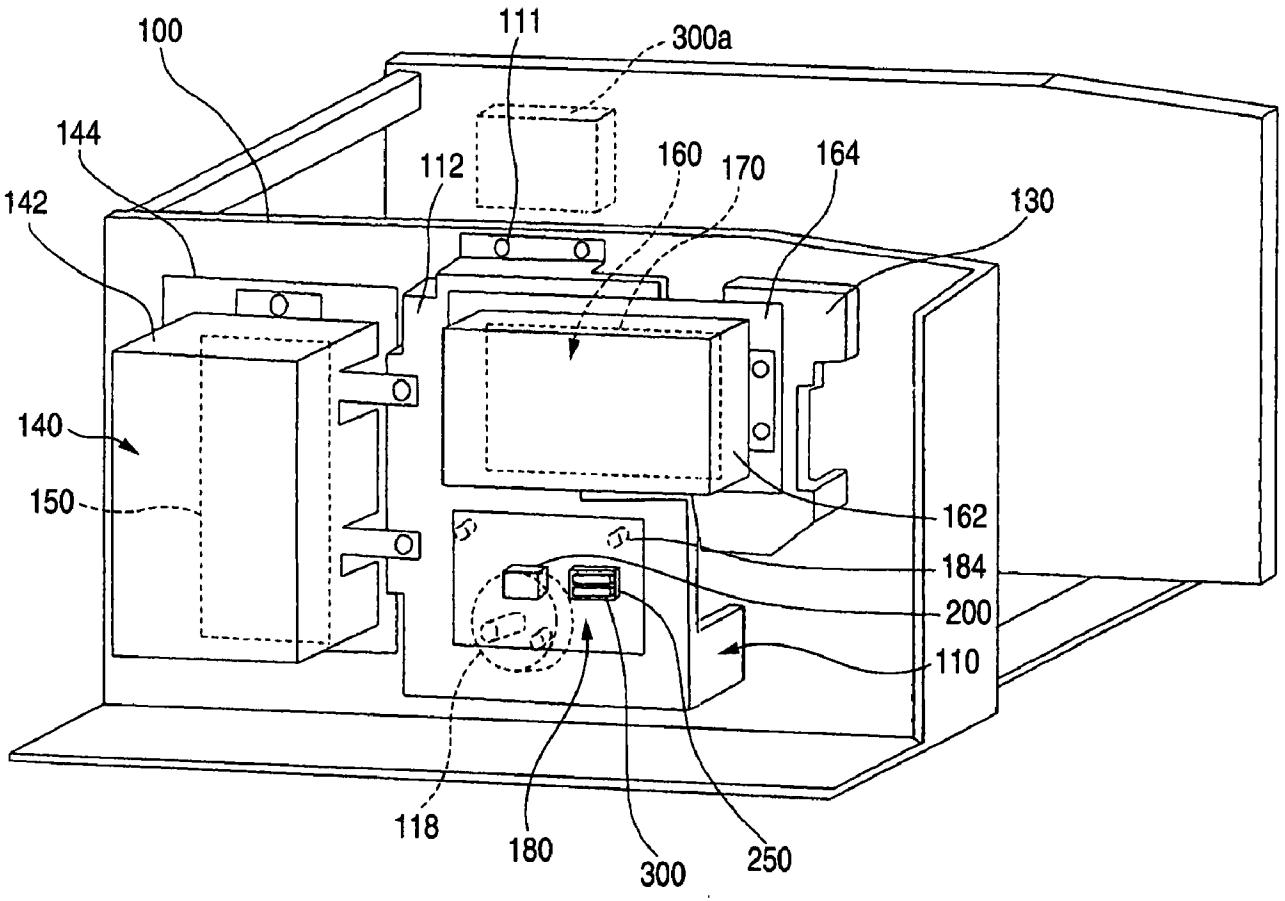
FIG. 4 is a perspective view schematically showing the layout of various components, which are located around a main motor.

The configuration and arrangement of elements related to the main motor 118, which transmits power to components of various types to be driven during image forming operations such as the photosensitive drum 27, will now be described with reference to FIGS. 1 through 4. FIG. 3 is a perspective view showing the arrangement of a gear unit 110. FIG. 4 is a perspective view schematically showing the arrangement of various components provided around the main motor 118.

First, the configuration and arrangement of the gear unit 110 having the main motor 118 will be described with reference to FIG. 3.

A main body frame 100, such as that shown in FIG. 3, is provided in the main body casing 2. The main body frame 100 is configured to retain various types of components shown in FIG. 2. As shown in FIG. 3, the gear unit 110 used for transmitting rotational driving force to the photosensitive drum 27 is mounted on one side surface of the main body frame 100. Further, amount plate 130 used for mounting a low-voltage power source board unit 160, which will be described later, is mounted on the side surface.

As shown in FIG. 3, the gear unit 110 is provided on one side surface of the main body frame 100. The gear unit 110 has the main motor 118 used for rotationally driving the photosensitive drum 27; a gear 114 which is coupled with a drive shaft (not shown) of the photosensitive gear 27 and transmits driving force from the main motor 118 to the photosensitive drum 27; and a gear 116 for transmitting the driving force from the main motor 118 to the gear 114. These members are supported by a gear frame 112. The upper and lower ends of the gear frame 112 are mounted to the main body frame 100 with screws 111, and the gear unit 110 is fixed to the main body frame 100.

The main motor 118 is provided on the same surface of the gear frame 112 where the gears 114 and 116 are mounted. A gear fixed to the main motor 118 meshes with the gear 116. Among the gears 114, 116 and the main motor 118, the main motor 118 is the heaviest and positioned at a mount location so as to come to a position beneath the gear unit 110.

The configuration and arrangement of various units, such as a circuit board unit, will now be described with reference to FIG. 4. Various units shown in FIG. 4, such as a circuit board unit, are provided on one side surface of the main body frame 100.

As shown in FIG. 4, elements mounted on one side surface of the main body frame 100, which supports the constituent elements of the laser printer 1 such as the image forming unit 5 or the like, include: the gear unit 110 and the mount plate 130 which have been previously described; a high-voltage power source board 140 acting as a first power supply unit which receives an input of AC commercial power source and is for converting the AC commercial power source into a DC power source used as the power source for the main motor 118; the low-voltage power source board unit 160 acting as a second power supply unit which is mounted to the gear unit 110 and the mount plate 130 and is for receiving an input of the AC commercial power source and converting the AC commercial power source into the DC power source used as a power source for the polygon motor 25; and a main board 180 which is mounted on the gear unit 110 and serves as a board which controls image forming operation and processes image data.

The high-voltage power source board unit 140 is mounted at a rear position of the laser printer 1 (i.e., the left position in FIG. 4). The low-voltage power source board 160 is mounted at a position opposing the upper portion of the gear unit 110.

The high-voltage power source board unit 140 and the low-voltage power source board unit 160 include electromagnetic shielding covers 142, 162; electromagnetic shielding plates 144, 164; a high-voltage power source board 150 to be described later; a low-voltage power source board 170, and the like. The electromagnetic shielding covers 142, 162 and the electromagnetic shielding plates 144, 164 are for suppressing the influence of electromagnetic noise having arisen outside the high-voltage power source board unit 140 or the low-voltage power source board unit 160 on the high-voltage power source board 150 and the low-voltage power source board 170, or for suppressing the influence of electromagnetic noise having arisen in the high-voltage power source board 150 or the low-voltage power source board 170 on external equipment, or the like.

The main board 180 is for controlling image forming operation by controlling the main motor 118, the polygon motor 25, and the like, and for processing image data in order to form an image. The main board 180 includes an ASIC 200 and an LSI 250. The LSI 250 functions as a package that includes a main motor driver 205*a* and a polygon motor driver

250*b*. For example, the package has a rectangle shape, which includes a short side (about 5-15 mm) and a long side (about 15-20 mm).

As shown in FIG. 4, a spacer 184 used for mounting the main board 180 is fixed to the gear frame 112 such that a gap exists between the main board 180 and the gear frame 112. The main board 180 is fastened to a lower portion of the gear frame 112 by way of the spacer 184 with screws.

The LSI 250 is provided with the heat radiation fin 300 acting as a heat radiation unit for radiating to the outside the heat originating from the main motor driver 205*a* and the polygon motor driver 250*b*.

So long as the heat radiation fin 300 is provided, occurrence of a failure, which would otherwise be caused as a result of the LSI 250 having become excessively hot, can be prevented. The main motor driver 250*a* and the polygon motor driver 250*b*, which respectively generate heat, are packed into a single package. Hence, providing only one heat radiation fin 300 is sufficient, which in turn leads to miniaturization of the laser printer 1.

Figure 5:
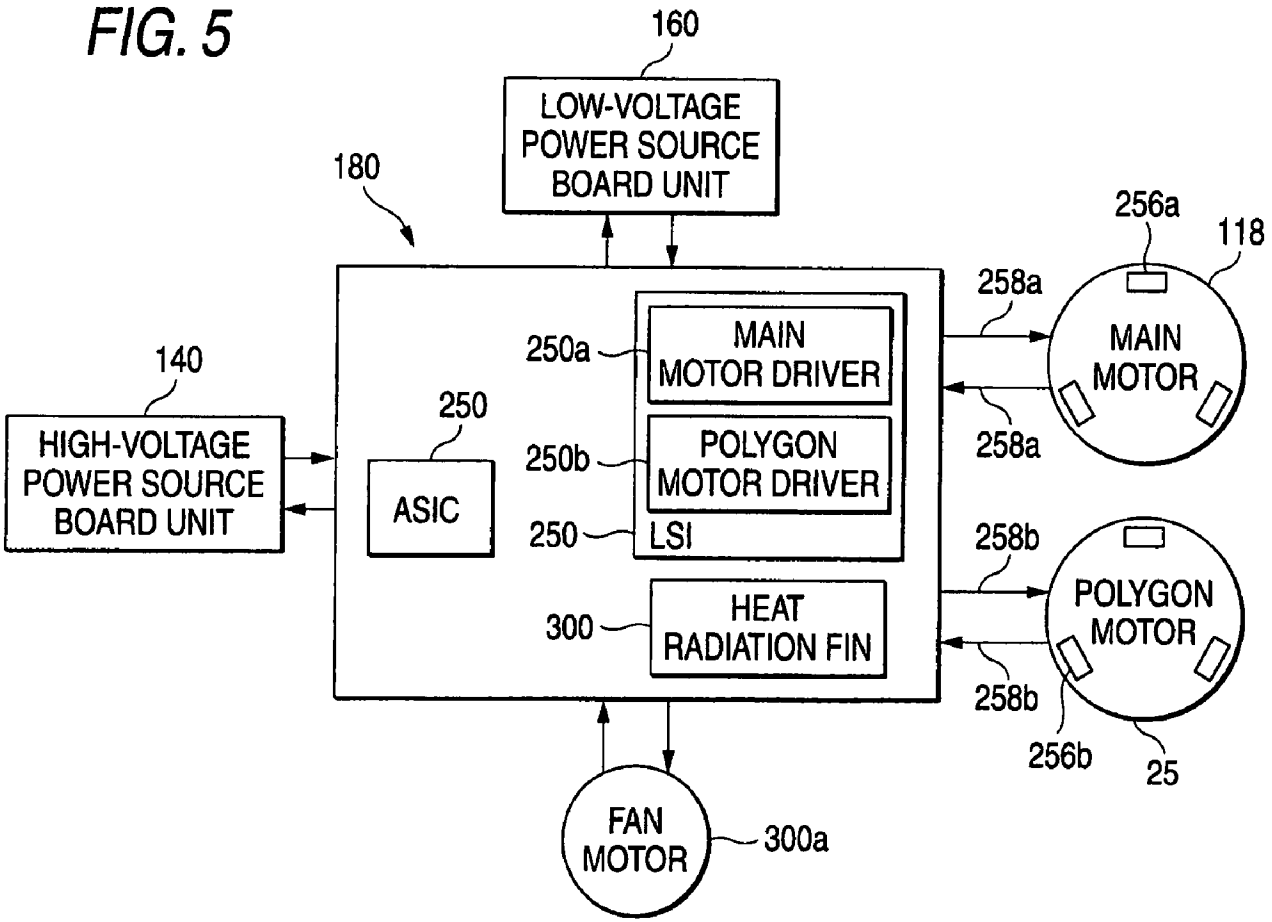
FIG. 5 is a block diagram schematically showing the entire configuration of the aspect.

The configuration for driving the main motor 118 and the polygon motor 25 in the laser printer 1 will be described with reference to FIG. 5. FIG. 5 is a block diagram schematically showing the entire configuration of the aspect.

As shown in FIG. 5, the configuration is formed by mounting, on the main board 180, the ASIC 200, and the LSI 250 into which are packed the main motor driver 250*a* acting as a main motor drive circuit and the polygon motor driver 250*b* acting as a polygon motor drive circuit. The ASIC 200 is configured to enable a digital input and output and perform digital processing. In accordance with the digital signal output from the ASIC, the main motor driver 250*a* and the polygon motor driver 250*b* drive the main motor 118 and the polygon motor 25, respectively.

The main motor driver 250*a* and the polygon motor driver 250*b* are packed as a single package and formed into the LSI 250, and the LSI 250 is mounted on the main board 180 along with the ASIC 200. Thus, the space between the two motor drivers 250*a* and 250*b* can be made smaller, which in turn enables miniaturization of the laser printer 1. Further, since the ASIC 200 and the LSI 250 are located in a vicinity of each other on the same board, EMI (Electro Magnetic Interference), which arises between the ASIC 200 that is a digital control circuit and the LSI 250 that is an analog control circuit can be lessened.

Three Hall elements 256*a* are provided on the main motor 118. Each of the Hall elements 256*a* is configured to produce an output according to the position of a rotor of the main motor 118. The output from the Hall element 256*a* is input to the main motor driver 250*a* packed in the LSI 250. The motor driver 250*a* amplifies the output from the Hall element 256*a*, and the output is converted into a digital signal by an A/D converter (not shown). The digitized Hall element signal is output to the ASIC 200. In accordance with the Hall element signal, the rotational speed of the main motor 118 can be detected. The ASIC 200 having detected the rotational speed of the main motor 118 grasps the position of the rotor of the main motor 118, and the ASIC 200 outputs to the main motor driver 250*a* a digital signal used for controlling the rotational speed of the main motor 118.

Since the main motor 118 needs to transmit driving force to the photosensitive drum 27 or various types of other constituent elements used for performing image forming operation, the main motor 118 has to generate large driving force. Therefore, the main motor 118 requires a supply of electric current in order to generate the large driving force. Hence, an electric current of 1.8 A is supplied from the low-voltage power source board unit 160 to the main motor driver 250*a* via a dedicated wire for the main motor driver 250*a*.

Figure 7:
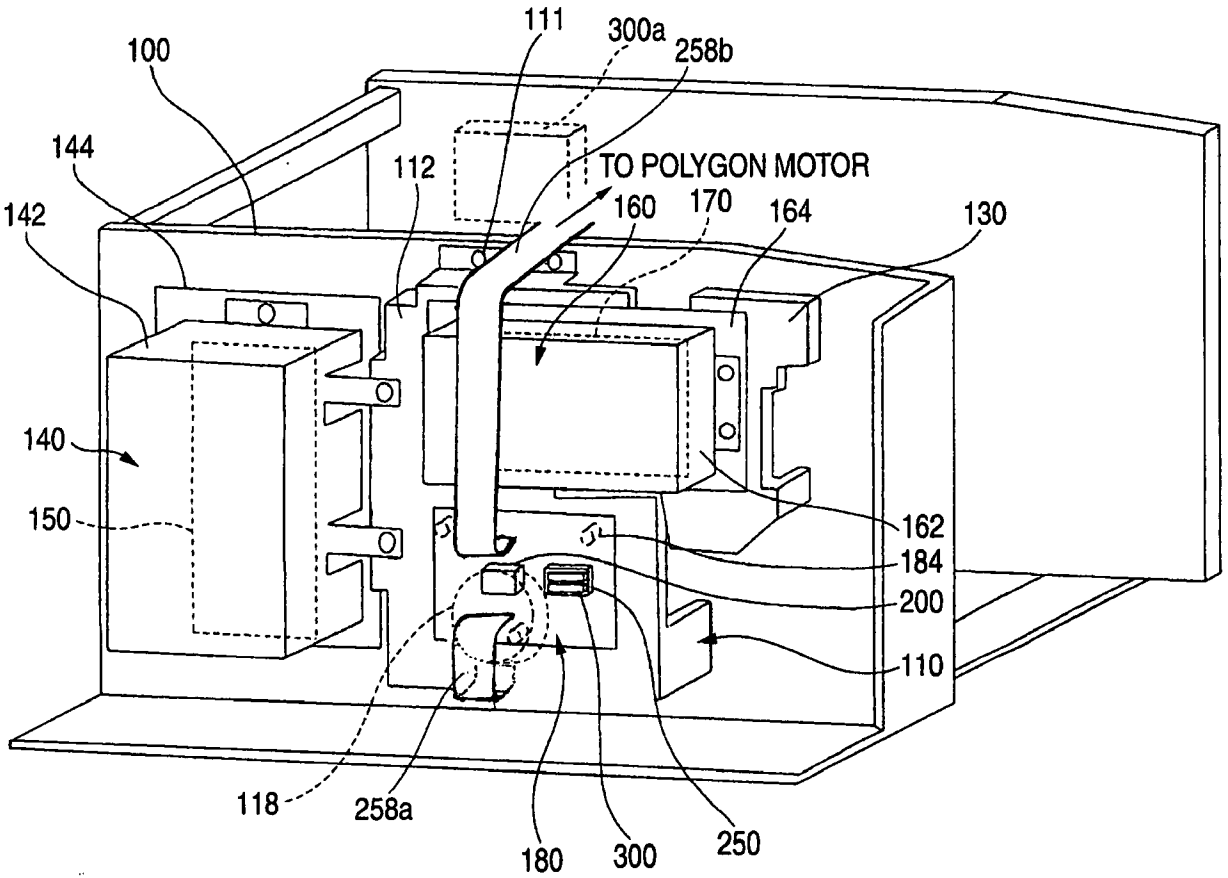
FIG. 7 is a perspective view schematically showing the layout of various components, which are located around a main motor.
Figure 8:
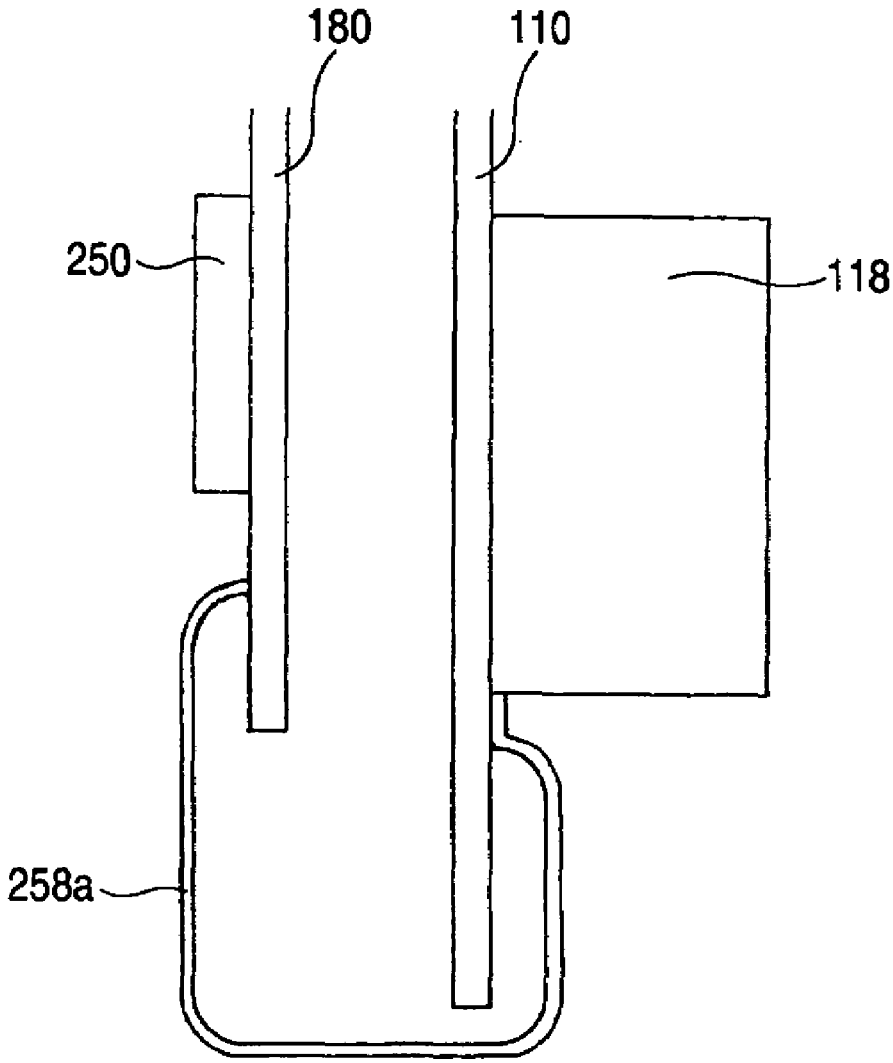
FIG. 8 is a perspective view schematically showing layout of various components, which are located around a lower portion of a gear frame.

As shown in FIGS. 7 and 8, the main board 180 is mounted to the lower portion of the gear frame 112 where the main motor 118 is disposed. Accordingly, the main motor 118 and the main motor driver 250*a* are placed in a vicinity of each other, and a wire 258*a* connecting the main motor 118 and the main motor driver 250*a* can be shortened. Occurrence of radiation noise, which is induced by the signal transmitted through the wire 258*a*, can be diminished.

Preferably, the wire 258*a* between the main motor 118 and the main motor driver 250*a* is shorter than 250 mm, and more preferably, shorter than 200 mm.

Preferably, the wire is a flat flexible cable (FFC).

The configuration for controlling driving of the polygon motor 25 is analogous to the configuration, such as that mentioned previously for controlling driving of the main motor 118.

Since the polygon motor 25 has to drive the polygon mirror 19 accurately, the polygon motor 25 requires a stable supply of electric current in order to prevent an uneven rotation. Hence, the low-voltage power source board unit 160 supplies an electric current of 0.4 A to the polygon motor driver 250*b* via a dedicated wire for the polygon motor driver 250*b*.

The wire, which is used for supplying electric current from the low-voltage power source board unit 160 to the main motor driver 250*a*, is disposed separately from the wire, which is used for supplying electric current from the low-voltage power source board unit 160 to the polygon motor driver 250*b*.

Figure 10:
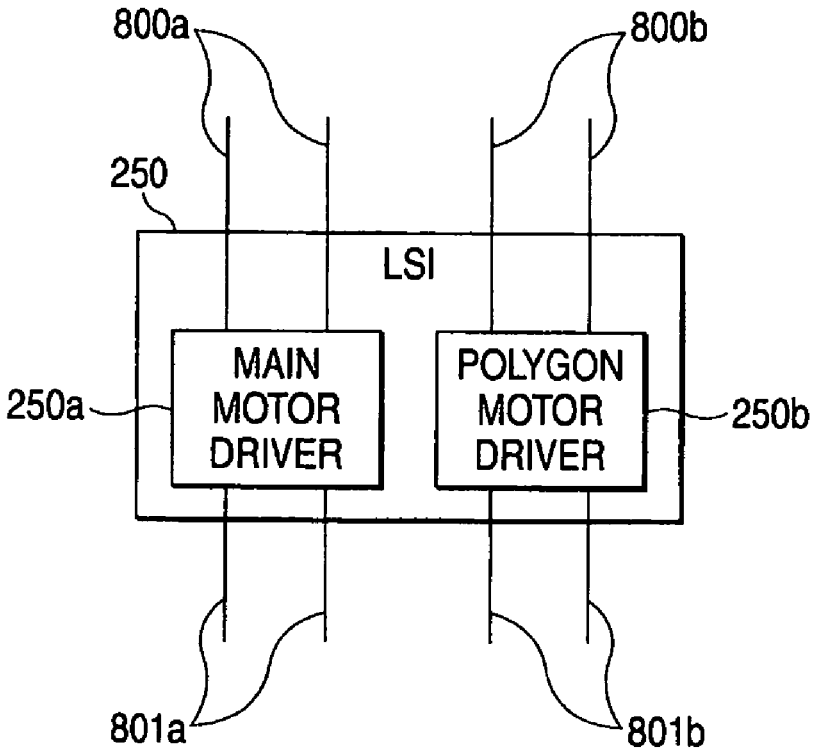
FIG. 10 is a block diagram schematically showing the layout of a main motor driver and a polygon motor driver according to one or more aspects of this invention.

As shown in FIG. 10, in the LSI 250, a pin 800*a* for supplying electric current to the main motor driver 250*a* and a pin 800*b* for supplying electric current to the polygon motor driver 250*b* are disposed separately. Further, in the LSI 250, a pin 801*a* for supplying electric current from the main motor driver 250*a* to the main motor 118 and a pin 801*b* for supplying electric current from the polygon motor driver 250*b* to the polygon motor 25 are disposed separately.

According to the above configuration, even if the electric current, which is supplied from the main motor driver 250*a* to the main motor 118, is rapidly changed due to a stating or a stopping of the main motor 118, the electric current, which is supplied to the polygon motor driver 250*b*, is protected from the changing. Further, the electric current, which is supplied from the polygon motor driver 250*b* to the polygon motor 25, is stabilized.

Accordingly, the polygon motor 25 can drive the polygon mirror 19 accurately.

Second Aspect

Figure 6:
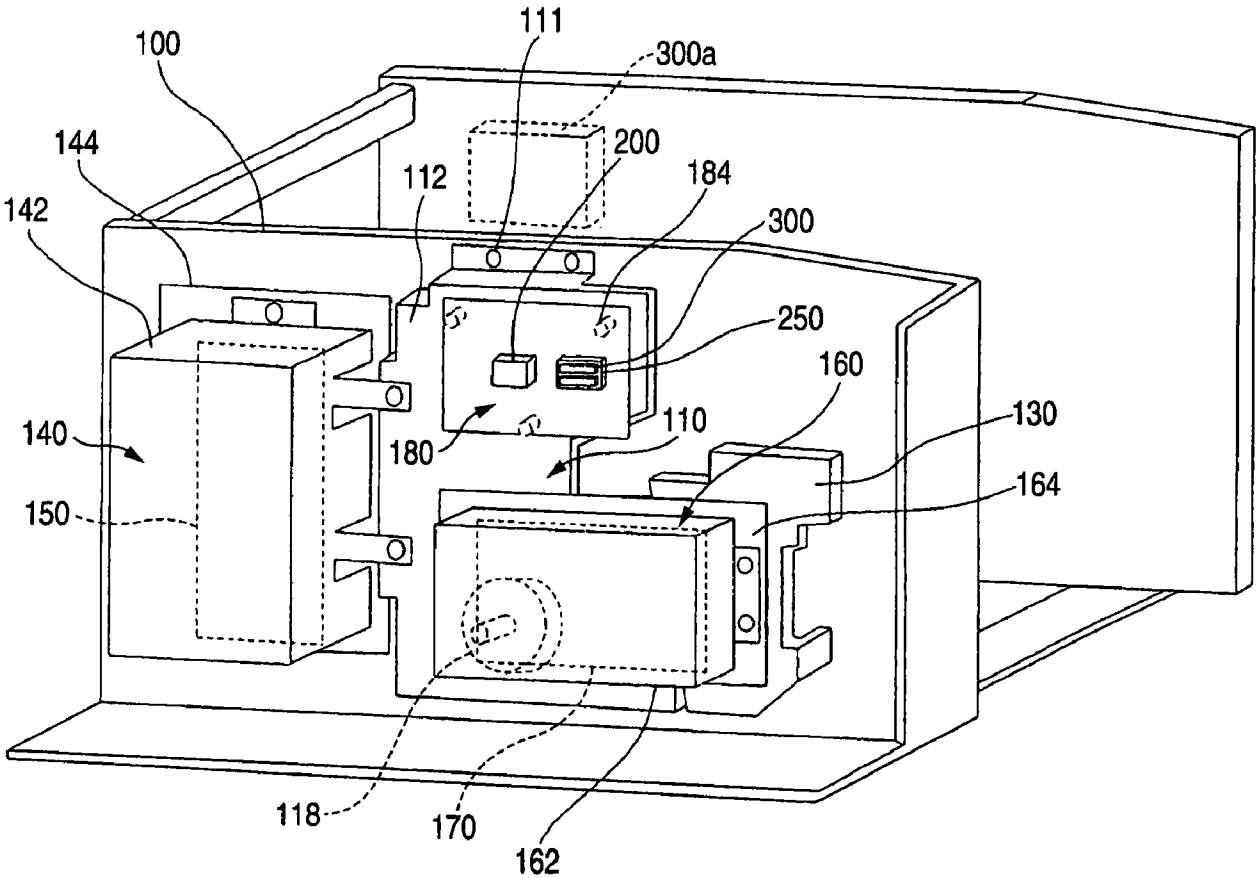
FIG. 6 is a perspective view schematically showing the layout of various components, which are located around a main motor in a laser printer according to another aspect of the invention.
Figure 9:
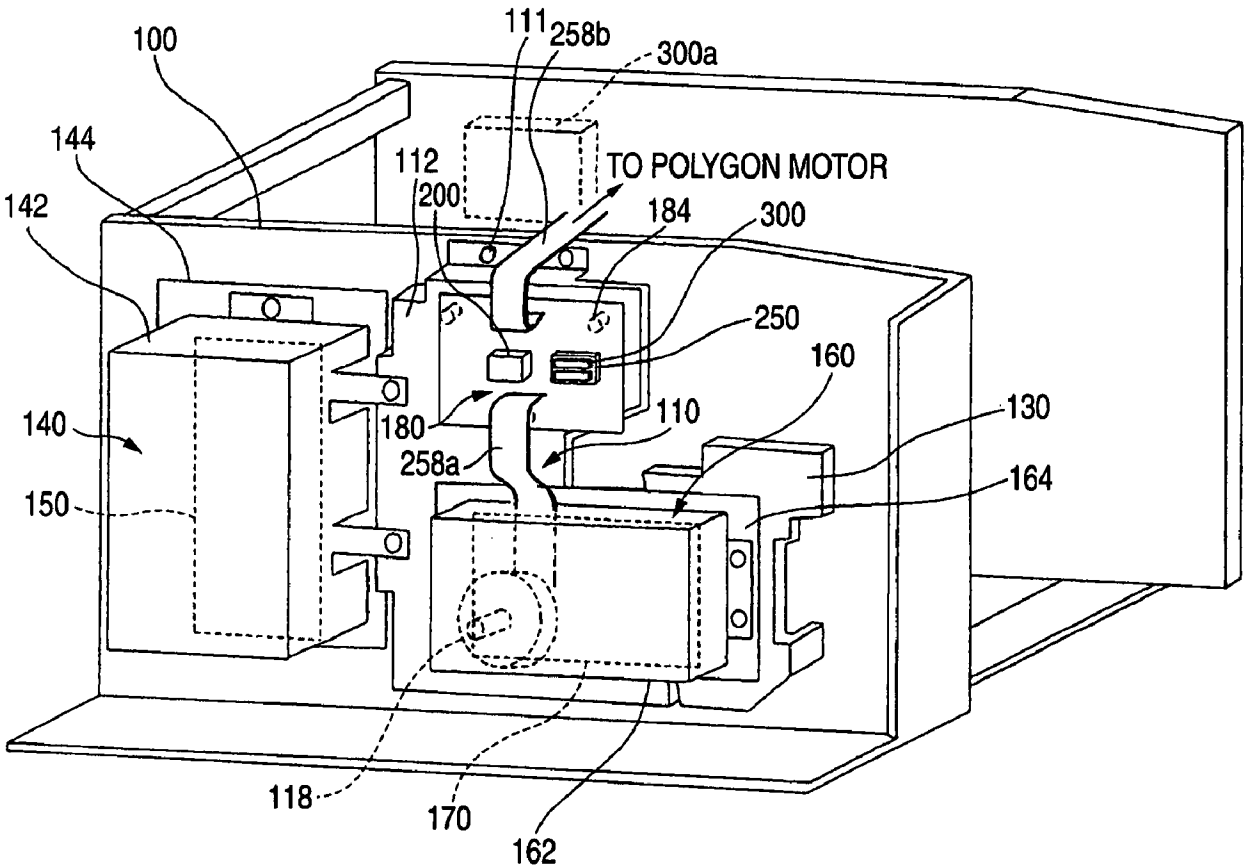
FIG. 9 is a perspective view showing the layout of various components, which are located around a main motor in a laser printer according to another aspect of the invention.

A laser printer, which functions as an image forming apparatus according to a second aspect, will now be described with reference to FIGS. 6 and 9. Constituent portions corresponding to those employed in the first aspect are assigned the same reference numerals, and their explanations which overlap the explanations of the counterparts of the first aspect are omitted for brevity. FIGS. 6 and 9 are perspective views schematically showing the arrangement of various components, which are located around the main motor 118 in the laser printer 1 of the present aspect.

As shown in FIG. 6, the second aspect differs from the first aspect in that the layout of the low-voltage power source board unit 160 and that of the main board 180 are interchanged.

In the first aspect, the main board 180 is placed in a vicinity to the main motor 118, thereby shortening the wire 258*a* that connects the main motor 118 to the main motor driver 250*a*, thereby lessening occurrence of radiation noise attributable to the signal transmitted over the wire 258*a*. In the present aspect, the main board 180 is provided at the upper portion of the gear frame 112, whereby the main board 180 and the polygon motor 25, which is provided at the inner elevated position of the laser printer 1, can be arranged in a vicinity of each other.

By such a configuration, a wire 258*b* connecting the polygon motor 25 to the polygon motor driver 250*b* can be shortened. Accordingly, rotational driving of the polygon mirror 19 can be stably performed even by the feeble Hall element signal traveling through the wire 258*a*, without causing the polygon motor 25 to operate falsely.

The aspects of the present invention have been described thus far. However, the present invention is not limited to the aspects set forth and is subjected to various modifications within the scope of technical idea of the present invention.

For instance, the main motor driver 250*a* and the polygon motor driver 250*b* are positioned in a vicinity of the main motor 118 or the polygon motor 25, and hence the LSI 250 may be moved over the main board 180, to thus change the layout.

According to the aspects, a distance between the ASIC and the LSI can be shortened, so that occurrence of EMI (electromagnetic interference) can be prevented.

According to the aspects, occurrence of failure of the apparatus, which would otherwise be caused as a result of an increase in the temperature of the apparatus caused by the heat originating from the LSI, can be prevented. The main motor drive circuit and the polygon motor drive circuit are constituted of a single LSI, and hence provision of only one heat radiation unit is sufficient.

According to the aspects, the main motor requires large driving force, and a large amount of electric current must be fed to the main motor drive circuit. Meanwhile, rotational accuracy of the polygon motor is sought. When an electric current is excessively fed to the polygon motor drive circuit, the rotation of the polygon motor becomes unstable for reasons of a voltage drop. Hence, an electric current is fed from the first power supply unit to the main motor drive circuit, and power is fed from the second power source unit to the polygon motor drive circuit. The electric current can be supplied from a independent power supply unit, whereby the rotational accuracy of the polygon motor can also be maintained while the large driving force of the main motor is sustained.

What is claimed is:

1. An image forming apparatus comprising:

a main motor configured to drive a photosensitive element;

a polygon motor configured to drive a polygon mirror;

at least one Hall element provided on the polygon motor that provides a signal which, at least in part, is used to detect and control a rotational speed of the polygon motor; and a board, the board supporting an integrated circuit, wherein the integrated circuit includes:

a main motor drive circuit configured to drive the main motor; and a polygon motor drive circuit configured to drive the polygon motor, and wherein the board is positioned in a vicinity of the polygon motor such that wire connecting the polygon motor to the polygon motor drive circuit is a length that will stabilize the Hall element signal transmitted through the wire so as to enhance to rotational accuracy of the polygon motor.

2. The image forming apparatus according to claim 1, wherein the board includes an ASIC that performs digital processing.

3. The image forming apparatus according to claim 1, further comprising:

a heat radiation unit that radiates heat originating from the board.

4. The image forming apparatus according to claim 1, further comprising:

a first power supply unit that supplies an electric current to the main motor drive circuit; and a second power supply unit that supplies an electric current to the polygon motor drive circuit.

5. The image forming apparatus of claim 1, wherein the board being in the vicinity of the polygon motor permits the polygon motor drive circuit to drive the polygon motor using the Hall element signal.

6. The image forming apparatus of claim 1, wherein the integrated circuit is a large scale integrated (LSI) circuit.

7. The image forming apparatus of claim 1, further comprising a gear frame wherein the board is positioned on the upper portion of the gear frame in the vicinity of the polygon motor.

8. The image forming apparatus of claim 1, wherein the wire between the main polygon motor drive circuit and the polygon motor is less than 250 millimeters.

9. An image forming apparatus comprising:

a main motor configured to drive a photosensitive element;

a polygon motor configured to drive a polygon mirror; and a board including:

a first integrated circuit which is configured to perform digital processing; and a second integrated circuit, which is physically separated on the board from the first integrated circuit, the second integrated circuit including:

a main motor drive circuit which is configured to supply current for driving the main motor to the main motor; and a polygon motor drive circuit which is configured to supply current for driving the polygon motor to the polygon motor, wherein the main motor drive circuit drives the main motor and the polygon motor drive circuit drives the polygon motor based on a digital output signal from the first integrated circuit, wherein the distance between the first integrated circuit and the second integrated circuit substantially prevents the occurrence of electromagnetic interference.

10. The image forming apparatus according to claim 9, wherein the first integrated circuit is an ASIC that performs digital processing.

11. The image forming apparatus according to claim 9, further comprising:

a heat radiation unit that radiates heat originating from the second integrated circuit.

12. The image forming apparatus according to claim 9, further comprising:

a first power supply unit that supplies an electric current to the main motor drive circuit; and a second power supply unit that supplies an electric current to the polygon motor drive circuit.

13. The image forming apparatus of claim 9, wherein the board is disposed in a vicinity of the main motor and reduces radiation noise attributable to a signal generated by the main motor drive circuit during driving of the main motor.

14. The image forming apparatus of claim 9, wherein a wire between the main motor drive circuit and the main motor is less than 250 millimeters.

15. The image forming apparatus of claim 9, wherein the second integrated circuit is a large scale integrated (LSI) circuit.

16. The image forming apparatus of claim 9, wherein the board is disposed in a vicinity of the polygon motor.

* * * * *